US010215022B2

(12) United States Patent
Tao

(10) Patent No.: US 10,215,022 B2
(45) Date of Patent: Feb. 26, 2019

(54) GUARD FILTERING SYSTEM FOR FOCUSED SAMPLING PROBE

(71) Applicant: Schlumberger Technology Corporation, Sugar Land, TX (US)

(72) Inventor: Chen Tao, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 142 days.

(21) Appl. No.: 15/106,404

(22) PCT Filed: Dec. 19, 2014

(86) PCT No.: PCT/US2014/071378
§ 371 (c)(1),
(2) Date: Jun. 20, 2016

(87) PCT Pub. No.: WO2015/095646
PCT Pub. Date: Jun. 25, 2015

(65) Prior Publication Data

US 2016/0341039 A1 Nov. 24, 2016

Related U.S. Application Data

(60) Provisional application No. 61/917,973, filed on Dec. 19, 2013.

(51) Int. Cl.

| | |
|---|---|
| ***E21B 33/12*** | (2006.01) |
| ***E21B 49/02*** | (2006.01) |
| ***E21B 49/08*** | (2006.01) |
| ***E21B 49/10*** | (2006.01) |

(52) U.S. Cl.
CPC ..... *E21B 49/10* (2013.01); *E21B 33/12* (2013.01); *E21B 49/02* (2013.01); *E21B 49/08* (2013.01)

(58) Field of Classification Search
CPC ..... E21B 49/08; E21B 49/10; E21B 49/081
See application file for complete search history.

(56) References Cited

U.S. PATENT DOCUMENTS

| | | | | |
|---|---|---|---|---|
| 3,782,191 | A * | 1/1974 | Whitten | E21B 49/10 166/100 |
| 3,813,936 | A * | 6/1974 | Urbanosky | E21B 49/10 73/152.25 |
| 3,859,851 | A * | 1/1975 | Urbanosky | E21B 49/10 73/152.24 |
| 3,864,970 | A * | 2/1975 | Bell | E21B 49/10 166/264 |
| 4,951,749 | A * | 8/1990 | Carroll | B01D 29/111 166/100 |

(Continued)

OTHER PUBLICATIONS

International Preliminary Report on Patentability issued in related PCT application PCT/US2014/071378 dated Jun. 30, 2016, 10 pages.

(Continued)

*Primary Examiner* — Jennifer H Gay
(74) *Attorney, Agent, or Firm* — Michael Dae

(57) ABSTRACT

The present disclosure relates to a method and apparatus for sampling a fluid from an environment having a primary filtering on a focused sampling probe and guard filtering system that is exposed upon movement of the focused sampling probe.

6 Claims, 4 Drawing Sheets

(56) References Cited

U.S. PATENT DOCUMENTS

| | | | | |
|---|---|---|---|---|
| 7,114,385 | B2 | 10/2006 | Fisseler et al. | |
| 7,121,338 | B2 | 10/2006 | van Zuilekom et al. | |
| 7,458,419 | B2 | 12/2008 | Nold, III et al. | |
| 8,220,536 | B2 | 7/2012 | Tao et al. | |
| 9,790,789 | B2 * | 10/2017 | Hejl | E21B 49/10 |
| 2006/0076132 | A1 * | 4/2006 | Nold, III | E21B 49/10<br>166/264 |
| 2007/0151727 | A1 | 7/2007 | Tao et al. | |
| 2008/0125973 | A1 | 5/2008 | Sherwood et al. | |
| 2008/0156486 | A1 * | 7/2008 | Ciglenec | E21B 49/10<br>166/250.15 |
| 2011/0162836 | A1 * | 7/2011 | Church | E21B 49/10<br>166/264 |
| 2012/0160514 | A1 * | 6/2012 | Evans, II | E21B 49/10<br>166/373 |
| 2013/0075088 | A1 | 3/2013 | Milkovisch et al. | |
| 2013/0081303 | A1 | 4/2013 | Tao et al. | |
| 2013/0081803 | A1 * | 4/2013 | Tao | E21B 49/10<br>166/247 |
| 2014/0174169 | A1 * | 6/2014 | Hejl | E21B 49/08<br>73/152.24 |
| 2016/0341039 | A1 * | 11/2016 | Tao | E21B 49/02 |

OTHER PUBLICATIONS

International Search Report and Written Opinion for International Application PCT/US2014/071378 dated Apr. 13, 2015.

* cited by examiner

GUARD FILTERING SYSTEM FOR FOCUSED SAMPLING PROBE

CROSS-REFERENCE TO RELATED APPLICATIONS

This application claims the benefit of U.S. Provisional Application No. 61/917,973, filed Dec. 19, 2013, the entire disclosure of which is hereby incorporated herein by reference.

BACKGROUND OF THE DISCLOSURE

Sampling of formation fluids is an important aspect of the oil and gas exploration industry. Sampling occurs on either a wireline or "while drilling" to allow engineers and drillers the ability to identify subsurface conditions.

As drilling of wellbores becomes more complex and directional drilling becomes more prevalent, ascertaining the position of petroleum bearing strata is important as the costs of drilling such wells increases.

Conventional sampling apparatuses, however, have significant drawbacks and present challenges for drillers and engineers. Sampling systems can become clogged with materials during the drilling process. Some geological conditions have a tendency to clog sampling systems to the degree that sampling is difficult.

Sampling systems can also be prone to other problems from mud or foreign particle intrusion. Probe systems, for example, may have articulated members that extend from a central body. The articulated members are used to help in formation sampling. The articulated members, however, are prone to fouling from downhole contaminants, thereby limiting the use of such members.

SUMMARY

The aspects described in this summary are to be considered but one possible example embodiment. As a consequence, the aspects described in the summary should not be considered limiting. A tool, having a probe with probe barrel movable from a retracted position to an extended position, the probe having an inner packer configured to seal against a first surface, the inner packer movable from the retracted position to the extended position and the probe further configured with a primary filter positioned in the probe, a primary filter piston configured to move the probe from the retracted position to the extended position, a primary flow line configured to transport a sample fluid from the primary filter to an interior of the tool, a guard filter configured to accept a fluid from an environment and filter the fluid, the guard filter configured around the probe when the probe is in the retracted position, a guard filter piston, wherein at least a portion of the guard filter piston is positioned within an inner diameter of the guard filter, the guard filter piston configured to move the guard filter relative to the probe and expose the guard filter to the environment, an outer packer configured around the guard filter, the outer packer configured to seal against a second surface and a secondary flowline located between the inner packer and the outer packer, wherein the secondary flowline accepts the fluid from the guard filter.

In another example embodiment, a method is disclosed having lowering a tool with a probe module into the wellbore, positioning the tool with the probe module against a formation, opening a flowline to the wellbore from an equalization valve, activating at least one pump such that fluid flow is accepted into a secondary flowline through a guard opening until a fluid sampled is clean enough to take a sample, accepting a fluid flow from a primary flowline when the fluid is clean, and capturing the fluid flow in a sample chamber.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
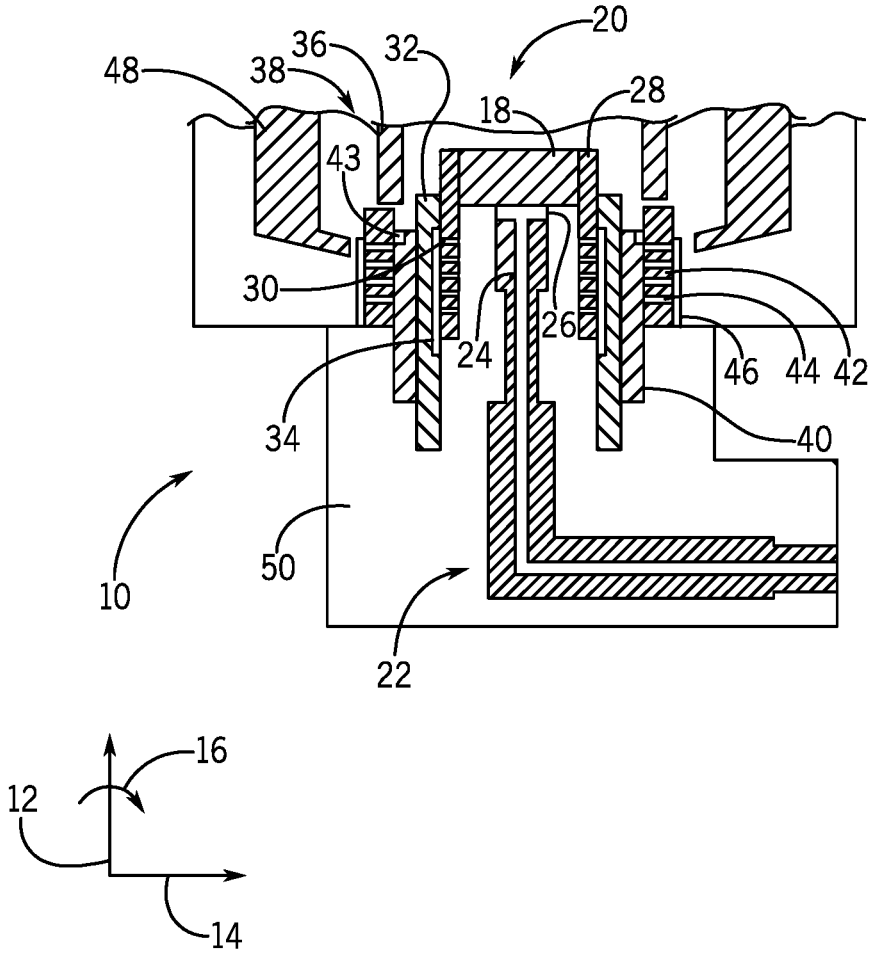
FIG. 1 is a cross-sectional view of a guard filtering system for a probe system wherein the probe system is retracted, according to aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The present disclosure relates to systems and methods for a downhole tool, such as a downhole tool that include a probe assembly. A downhole tool may be one of various tools deployed into a wellbore by means such as a drill string, wireline, and coiled tubing for performing downhole operations related to the evaluation, production, and/or management of one or more subsurface formations of interest. The probe assembly may include one or more probes that are extended from the downhole tool to isolate a region of the wellbore wall, and thereby establish fluid communication with the formation surrounding the wellbore. Fluid may then be drawn into the downhole tool using the probe. A typical probe employs a body that is extendable from the downhole tool and carries a packer at an outer end thereof for positioning against a sidewall of the wellbore. Such packers may include a relatively large element that can be deformed easily to contact the uneven wellbore wall (in the case of open hole evaluation), yet retain strength and sufficient integrity to withstand the anticipated differential pressures. These packers may be set in open holes or cased holes. They may be run into the wellbore on various downhole tools. While aspects of the disclosure are described in relation to a wireline tool, the same concepts can be applied to a "while drilling" tool. The aspects described herein, therefore, are not to be considered limiting. In addition, certain embodiments of the tool may include pumpout capabilities such that one or more pumps are used to obtain samples of formation fluid and move the formation fluid throughout the tool. In addition, embodiments of the tool may include various pressure measurement and sampling capabilities.

Referring generally to FIG. 1, a cross-sectional view of an embodiment of a focused probe module 10 is illustrated as deployed in a wellbore. The focused probe module 10 may be one component of a downhole tool. The focused probe module 10 may have an axial axis or direction 12, a radial axis or direction 14, and a circumferential axis or direction 16. Thus, FIG. 1 shows an axial 12 cross-sectional view of the focused probe module 10. The term focused may be used to refer to a probe module that includes one or more features that enable the focused probe module 10 to obtain cleaner (e.g., with fewer contaminants) formation fluid than a probe module without such features. The focused probe module 10 includes a plurality of components that are generally arranged concentrically about one another. In certain embodiments, one or more of the components of the focused probe module 10 may have a radial cross-sectional shape that is circular, oval, square, rectangular, or any other suitable shape for focused sampling. The following description will begin with the components disposed near the axial axis 12 of the focused probe module 10 and then move radially 14 outward from there. As will be described with respect to FIGS. 1-3, the focused probe module 10 is configured to move through several different configurations in the course of formation fluid sampling and the phase shown in FIG. 1 may be described as a retracted configuration.

The focused probe module 10 may include a primary filter piston 18 that may be used to control the flow of formation fluid into a primary portion 20 of the focused probe module 10, as described in more detail below. The primary filter piston 18 may include a primary filter piston actuator 22 that may be used to move the primary filter piston 18 up or down in the axial direction 12. The terms up and down are used in the following discussion for convenience with respect to FIGS. 1-3, but the focused probe module 10 may actually be disposed at a variety of different angles within the wellbore. The primary filter piston actuator 22 may use various techniques for moving the primary filter piston 18, such as, but not limited to, hydraulics, mechanical techniques, electrical techniques, motors, or any combination thereof. The primary filter piston 18 may include a primary flowline 24 for conveying clean (e.g., substantially free of contaminants) formation fluid to another portion of the downhole tool for storage or analysis. In certain embodiments, the primary flowline 24 may extend through an interior of the primary filter piston 18 and/or primary filter piston actuator 22. For example, the primary flowline 24 may extend through the center of the primary filter piston 18 and/or primary filter piston actuator 22. The primary flowline 24 may include one or more openings 26 to enable the formation fluid to enter the primary flowline 24.

A primary filter 28 may be disposed concentrically surrounding at least a portion of the primary filter piston 18. The primary filter 28 may include one or more primary filter openings or slots 30 to block particles and other debris from entering the primary flowline 24, as described in more detail below. In other words, the primary filter 28 may be used to prevent clogging or blockage of the primary flowline 24. The sizes of the primary filter openings or slots 30 may be selected to substantially block the passage of particles and other debris through the primary filter openings or slots 30 and yet allow the passage of formation fluid. In certain embodiments, the primary filter 28 may have a generally cylindrical shape with an interior surface of the primary filter 28 abutting the primary filter piston 18 to substantially block the flow of formation fluid in the axial direction 12 toward the primary filter piston actuator 22. The primary filter 28 may also be removable so that the filter 28 may be replaced when clogged or when a different size or configuration of filter is desired. In certain embodiments, a portion (e.g., a primary filter 28 debris scraping portion) of the primary filter piston 18 may removable via a threaded connection to enable the portion to be replaced when it is worn or damaged without replacing the entire primary filter piston 18. A probe barrel 32 may be disposed concentrically surrounding at least a portion of the primary filter 28 and the primary filter piston 18. In certain embodiments, the probe barrel 32 may have a generally cylindrical shape. The probe barrel 32 may be used to move the primary portion 20 up or down in the axial direction 12, as described in detail below. Thus, the probe barrel 32 may be coupled to the primary filter 28 and/or the primary filter piston 18. In certain embodiments, the probe barrel 32 may include a primary flowline channel 34 to enable formation fluid flowing through the primary filter 28 to enter the primary flowline 24, as described in detail below.

An inner packer 36 may be disposed concentrically surrounding at least a portion of the primary filter 28. The inner packer 36 may be made from a flexible material, such as, but not limited to, rubber, plastic, elastomers, or any combination thereof, to help provide a seal against the formation. In certain embodiments, the inner packer 36 may generally extend axially 12 beyond the primary filter 28 and primary filter piston 18 in a direction toward the formation. Thus, when the focused probe module 10 is extended toward the formation, the inner packer 36 contacts the formation, thereby establishing a seal against the formation. The primary portion 20 may include the primary filter piston 18, primary filter piston actuator 22, primary filter 28, probe barrel 32, and inner packer 36.

As shown in FIG. 1, a guard portion 38 may concentrically surround the primary portion 20. Specifically, a guard filter piston 40 may be disposed concentrically surrounding at least a portion of the probe barrel 32. In certain embodiments, the guard filter piston 40 may be abutting the probe barrel 32 and may have a generally cylindrical shape. A guard filter 42 may be disposed concentrically surrounding at least a portion of the guard filter piston 40. The guard filter 42 may include one or more guard filter openings or slots 44 to block particles and other debris from entering a secondary flowline 46, as described in more detail below. In other words, the guard filter 28 may be used to prevent clogging or blockage of the secondary flowline 46. The sizes of the guard filter openings or slots 44 may be selected to substantially block the passage of particles and other debris through the guard filter openings or slots 44 and yet allow the passage of formation fluid. In certain embodiments, the guard filter 42 may have a generally cylindrical shape with an interior surface of the guard filter 42 abutting the guard filter piston 40 to substantially block the flow of formation fluid in the axial direction 12 toward the primary filter piston actuator 22. The guard filter 42 may also be removable so that the filter 42 may be replaced when clogged or when a different size or configuration of filter is desired. In certain embodiments, the guard filter piston 40 may include a debris scraper 43 that may be used to scrape particles and debris from the inner surface of the guard filter 42 as the guard filter piston moves axially 12. In certain embodiments, the debris scraper 43 may be made from a harder or more durable material than the guard filter piston 40. Further, the debris scraper 43 may be coupled to the guard filter piston 40 via a threaded connection to enable the debris scraper 43 to be replaced when it is worn or damaged.

An outer packer 48 may be disposed concentrically surrounding at least a portion of the guard filter 42. Thus, the secondary flowline 46 may be disposed between the inner and outer packers 36 and 48. The outer packer 48 may be made from a flexible material, such as, but not limited to, rubber, plastic, elastomers, or any combination thereof, to help provide a seal against the formation. In certain embodiments, the outer packer 48 may generally extend axially 12 beyond the guard filter 42 and guard filter piston 40 in a direction toward the formation. Thus, when the focused probe module 10 is extended toward the formation, the outer packer 48 contacts the formation, thereby establishing a seal against the formation. The guard portion 38 may include the guard filter piston 40, guard filter 42, and outer packer 48. The primary portion 20 and guard portion 38 may be used together to provide focused sampling of the formation fluid. In other words, the inner packer 36 of the primary portion 20 provides a smaller, inner sealed portion separate from a larger, concentrically surrounding sealed portion provided by the outer packer 48 of the guard portion 38. Thus, the primary portion 20 is more likely to provide sampling of clean formation fluid compared to the formation fluid obtained in the guard portion 38. One or more components of the focused probe module 10 may be supported by or coupled to a probe shoe 50.

Figure 2:
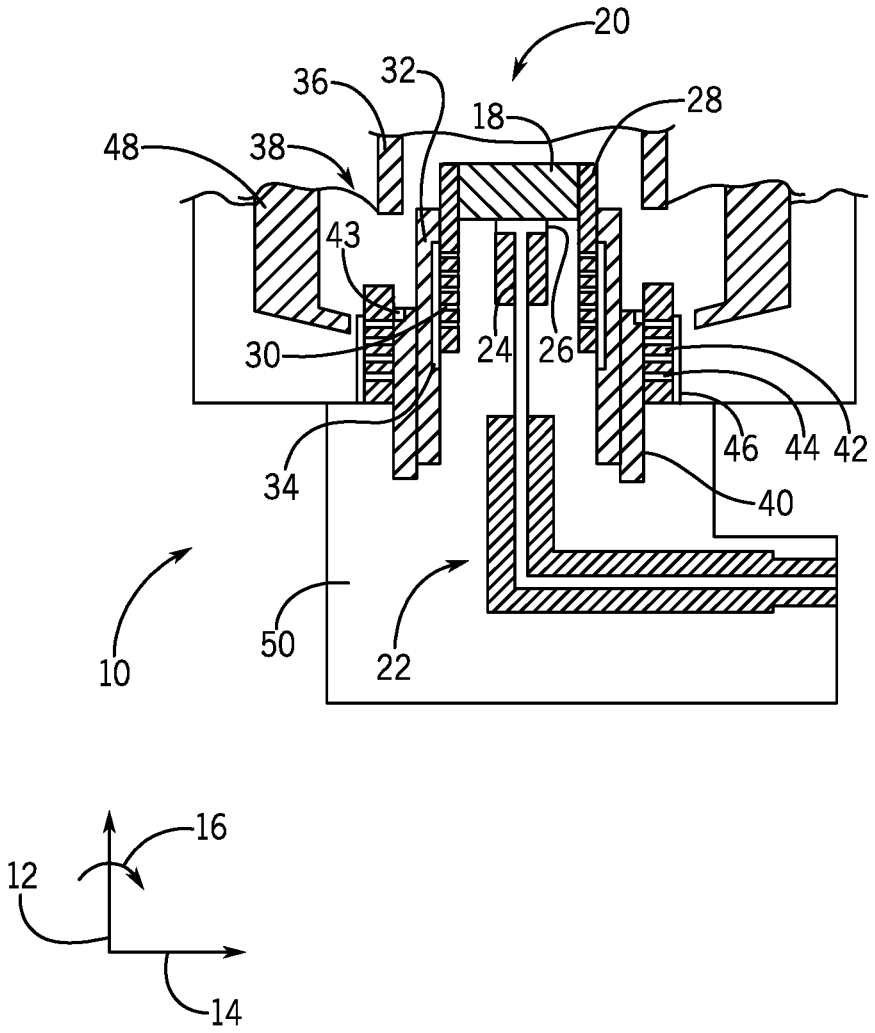
FIG. 2 is a cross-sectional view of a guard filtering system for a probe system wherein the probe barrel is extended, according to aspects of the present disclosure.

FIG. 2 is an axial 12 cross-sectional view of an embodiment of the focused probe module 10 in an extended configuration with the probe barrel 32 extended. As shown in FIG. 2, the probe barrel 32 has moved in the axial 12 direction away from the primary filter piston actuator 22 and toward the formation. Specifically, hydraulics, mechanics, or electronics may be used to move the probe barrel 32. Accordingly, the inner packer 36, primary filter piston 18, and primary filter 28 are also moved toward the formation until the inner packer 36 contacts the wellbore wall, thereby establishing a seal with the wellbore wall. As the positions of the primary filter piston 18 and primary filter 28 have not changed, the primary filter piston 18 continues to substantially block the flow of formation fluid into the focused probe module 10. The other components of the focused probe module 10 remain in substantially the same positions as shown in FIG. 1. Specifically, the guard filter piston 40 and guard filter 42 does not move with the probe barrel 32.

Figure 3:
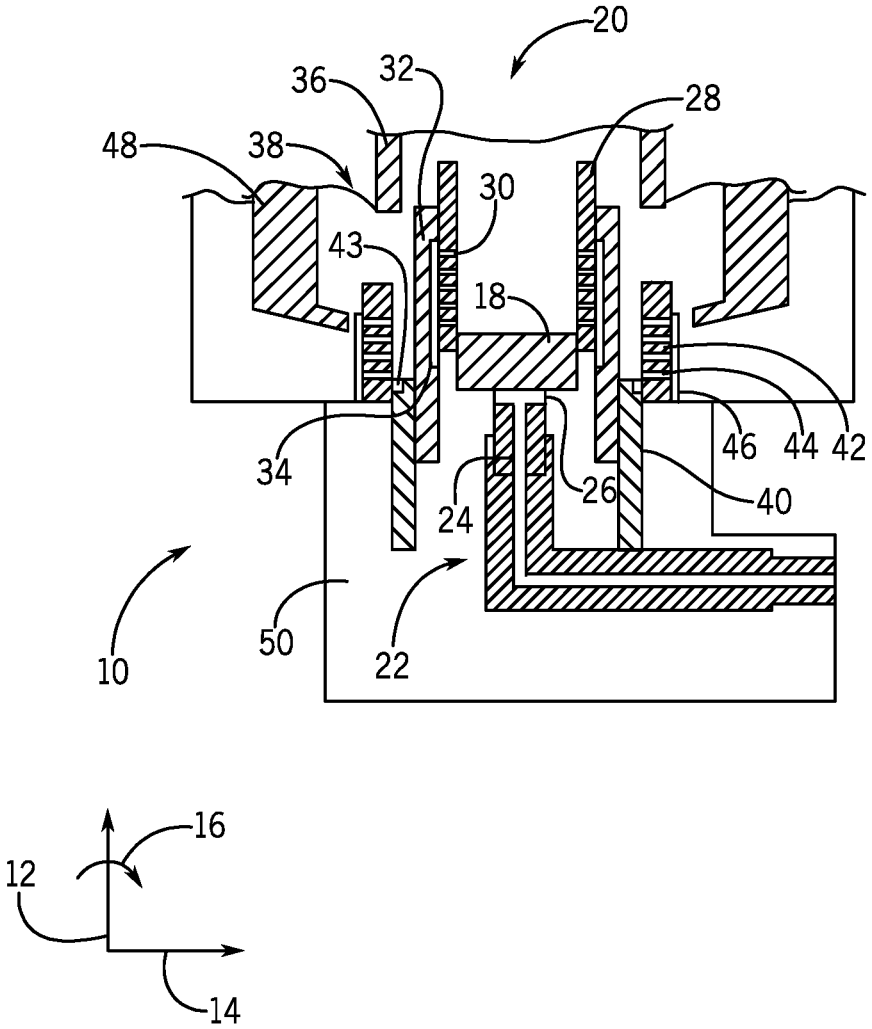
FIG. 3 is a cross-sectional view of a guard filtering system for a probe system wherein the probe barrel is extended out and both filter pistons are withdrawn, exposing primary and secondary filtering areas, according to aspects of the present disclosure.

FIG. 3 is an axial 12 cross-sectional view of an embodiment of the focused probe module 10 in a sampling configuration with both the primary filter piston 18 and guard filter piston 40 retracted. As shown in FIG. 3, both the primary filter piston 18 and guard filter piston 40 have moved in the axial 12 direction toward the primary filter piston actuator 22 and away from the formation. Specifically, the primary filter piston actuator 22 has moved the primary filter piston 18 axially 12 toward itself and hydraulics, mechanics, or electronics may be used to move the guard filter piston 40. Thus, in certain embodiments, the movement of the primary portion 20 may be independent from the movement of the guard portion 38. Accordingly, clean formation fluid moves into the primary filter 28, passes through the primary filter openings or slots 30, enters the openings 26, and flows through the primary flowline 24. As described above, the primary filter 28 blocks particles and other debris from entering the primary flowline 24. In addition, contaminated formation fluid moves into the guard filter 42, passes through the guard filter openings or slots 44, and flows through the secondary flowline 46. As described above, the guard filter 28 blocks particles and other debris from entering the secondary flowline 24. In certain embodiments, the clean formation fluid in the primary flowline 24 may be segregated from the contaminated formation fluid within the downhole tool. For example, contaminated fluid may be stored inside sections of the tool or may be ejected to the wellbore. The other components of the focused probe module 10 remain in substantially the same positions as shown in FIGS. 1 and 2. After sampling is complete, the focused probe module 10 may return to the extended configuration of FIG. 2 and then to the retracted configuration of FIG. 1 before the downhole tool is moved to another sampling location. Thus, the axial 12 movement of the primary filter piston 18 and the guard filter piston 40 help to remove or scrape off any debris or particles from the surfaces of the primary filter 28 and guard filter 42, respectively, after each setting of the focused probe module 10. In addition, there is no accumulation of debris or particles within the primary or secondary flowlines 24 and 46 because of the primary filter 28 and guard filter 42, respectively.

Figure 4:
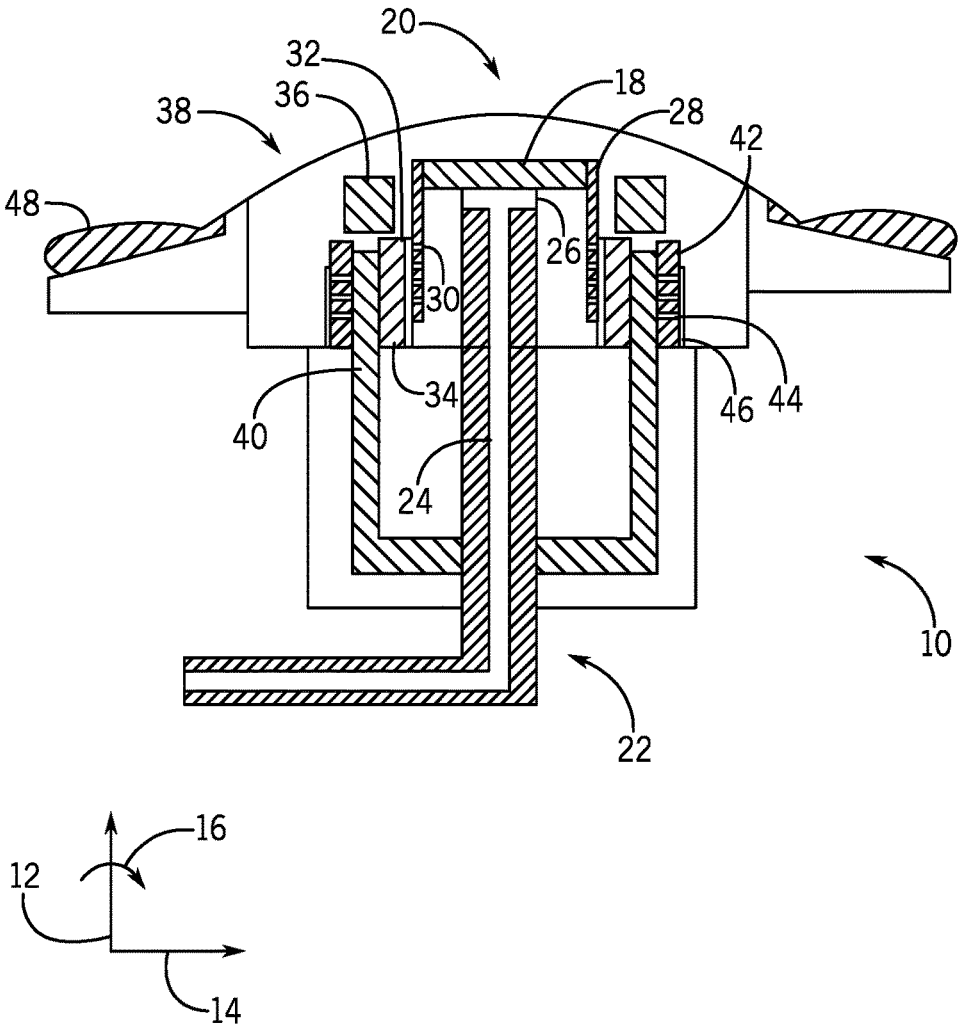
FIG. 4 is a cross-sectional view of a guard filtering system for a probe system wherein the probe barrel and guard filter piston reside in different hydraulic ports, according to aspects of the present disclosure.

FIG. 4 is an axial cross-sectional view of another embodiment of the focused probe module 10. Elements in common with those shown in FIGS. 1-3 are labeled with the same reference numerals. The focused probe module shown in FIG. 4 is in the retracted configuration, but may also be positioned in the extended configuration similar to that shown in FIG. 2 and the sampling configuration shown in FIG. 3. As shown in FIG. 4, the probe barrel 32 and guard filter piston 40 reside in different hydraulic ports. Such a configuration may provide for additional control of the moving sequence (e.g., from the retracted configuration to the extended configuration to the sampling configuration and vice versa) for the probe barrel 32 and the guard filter piston 40 than if the probe barrel 32 and guard filter piston resided in the same hydraulic port. In other respects, the focused probe module 10 is similar to that shown in FIGS. 1-3.

In certain embodiments, the process for using the focused probe module 10 with the downhole tool may include the following steps. In a first step, the tool including the focused probe module 10 is lowered into the wellbore. The focused sample module 10 is in the retracted configuration of FIG. 1. In a second step, hydrostatic pressure may be automatically applied to a backside of a compensating piston, which may increase the pressure of the hydraulic system. In a third step, the primary and/or secondary flowlines 24 and 46 are opened to the borehole from equalization valves in the focused probe module 10 or a packer module of the downhole tool. In a fourth step, the tool is set in place for testing and back up pistons and the probe are extended. In other words, the focused probe module 10 moves into the extended configuration of FIG. 2 and then into the sampling configuration of FIG. 3. In a fifth step, formation fluid flows in the primary and secondary flowlines 24 and 46 and pretesting of the clean formation fluid in the primary flowline 24 is activated. In a sixth step, a decision is made whether to take a sample based on the pretest data. The decision may be made based on optical spectrometry or other measurement systems that allow for identification of contamination levels in the formation fluid flowing through the primary flowline 24. In a seventh step, if sampling is desired, pumps of the downhole tool are activated to draw in formation fluid until the fluid is clean enough to take a sample. In an eighth step, valves are closed when sample chambers are full and the probe and pistons are retracted (e.g., the focused probe module 10 returns to the retracted configuration of FIG. 1). The sample chambers may be determined to be full by monitoring pressures of the primary and/or secondary flowlines 24 and 46. In a ninth step, tests may be repeated at the same or different locations of the wellbore.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A tool, comprising:

a probe with a probe barrel movable from a retracted position to an extended position, the probe having an inner packer configured to seal against a first surface, the inner packer movable from the retracted position to the extended position and the probe further configured with a primary filter positioned in the probe;

a primary filter piston connected to the probe and configured to move the probe from the retracted position to the extended position, wherein the probe barrel is disposed concentrically surrounding at least a portion of the primary filter and the primary filter piston;

a primary flowline configured to transport a sample fluid from the primary filter to an interior of the tool;

a guard filter configured to accept a fluid from an environment and filter the fluid, the guard filter configured around the probe when the probe is in the retracted position;

a guard filter piston configured to move the guard filter relative to the probe and expose the guard filter to the environment, wherein the guard filter piston is disposed concentrically surrounding at least a portion of the probe barrel, and wherein the guard filter is disposed concentrically surrounding at least a portion of the guard filter piston;

an outer packer configured around the guard filter, the outer packer configured to seal against a second surface; and a secondary flowline located between the inner packer and the outer packer, wherein the secondary flowline accepts the fluid from the guard filter.

2. The tool according to claim 1, wherein the primary flowline is located through a center of the inner packer.

3. The tool according to claim 1, wherein the secondary flowline is configured radially outside the probe barrel and the inner packer.

4. The tool according to claim 1, wherein the primary filter comprises one or more primary filter openings or slots configured to block particles and other debris from entering the primary flowline.

5. The tool according to claim 1, wherein the guard filter comprises one or more guard filter openings or slots configured to block particles and other debris from entering the secondary flowline.

6. The tool according to claim 1, wherein the probe barrel comprises a primary flowline channel configured to enable formation fluid flowing through the primary filter to enter the primary flowline.

* * * * *